US008139977B2

(12) United States Patent
Fukuda

(10) Patent No.: US 8,139,977 B2
(45) Date of Patent: Mar. 20, 2012

(54) IMAGE FORMING APPARATUS WITH SUPPORTING MEMBER

(75) Inventor: Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/703,773

(22) Filed: Feb. 8, 2007

(65) Prior Publication Data

US 2007/0201899 A1 Aug. 30, 2007

(30) Foreign Application Priority Data

Feb. 28, 2006 (JP) ..... 2006-052962

(51) Int. Cl.
*G03G 15/00* (2006.01)

(52) U.S. Cl. ..... 399/107; 399/108

(58) Field of Classification Search ..... 399/107, 399/108–114
See application file for complete search history.

(56) References Cited

U.S. PATENT DOCUMENTS

| | | | | |
|---|---|---|---|---|
| 5,899,601 | A * | 5/1999 | Yamaguchi et al. | 399/110 |
| 6,308,025 | B1 * | 10/2001 | Okano et al. | 399/107 |
| 6,662,427 | B2 * | 12/2003 | Miyahara | 29/557 |
| 2005/0069340 | A1 * | 3/2005 | Noda et al. | 399/107 |
| 2006/0182462 | A1 * | 8/2006 | Imada et al. | 399/107 |
| 2007/0230995 | A1 * | 10/2007 | Yokota et al. | 399/107 |

FOREIGN PATENT DOCUMENTS

| | | | |
|---|---|---|---|
| JP | 06202389 | A * | 7/1994 |
| JP | 06-211363 | | 8/1994 |
| JP | 2004154537 | A * | 6/2004 |

OTHER PUBLICATIONS

Machine Translation JP 2004-154537.*
English Abstract JP 2004-154537.*

* cited by examiner

*Primary Examiner* — Hoan Tran
(74) *Attorney, Agent, or Firm* — Kubotera & Associates, LLC

(57) ABSTRACT

An image forming apparatus includes a plurality of image forming units; a pair of supporting members for supporting both end portions of each of the image forming units; and a leg portion abutting against a mounting surface at a lower surface of each of the supporting members.

5 Claims, 15 Drawing Sheets

IMAGE FORMING APPARATUS WITH SUPPORTING MEMBER

BACKGROUND OF THE INVENTION AND RELATED ART STATEMENT

The present invention relates to an image forming apparatus.

In a conventional image forming apparatus such as a printer, a copier, and a facsimile, a plurality of image forming units (developing devices) is disposed for attaching toner to a latent image formed on a surface of a photosensitive drum to form a toner image. In the image forming unit, a toner cartridge is detachably attached to a main body of the image forming unit for retaining toner.

A sheet cassette is disposed in the image forming unit for supplying a sheet as a recording medium. A base plate is disposed on guide members arranged at left and right sides of the sheet cassette, and an apparatus main body of the printer is mounted on the base plate.

Patent Reference: Japanese Patent Publication No. 06-211363

In the conventional printer described above, when the printer is provided with a plurality of image forming units, each of the image forming units can be detachably attached to a metal plate structure as a supporting member. It is necessary, however, to provide the guide members and the base plate between a mounting surface for mounting the printer and the metal plate structure. Accordingly, due to dimensional variances of components such as the guide members, the base plate, the metal plate structure, and the likes, it is difficult to precisely mount the image forming units. As a result, a color shift may occur upon forming an image or printing, thereby deteriorating image quality.

In view of the problems described above, an object of the present invention is to provide an image forming apparatus, in which it is possible to solve the problems in the conventional printer. In particular, it is possible to accurately mount an image forming unit and improve image quality.

Further objects and advantages of the invention will be apparent from the following description of the invention.

SUMMARY OF THE INVENTION

In order to attain the objects described above, according to the present invention, an image forming apparatus comprises a plurality of image forming units; a pair of supporting members for supporting both end portions of each of the image forming units; and a leg portion abutting against a mounting surface at a lower surface of each of the supporting members.

In the present invention, the leg portion abuts against the mounting surface at the lower surface of each of the supporting members. Accordingly, dimensional variances of components are not accumulated. As a result, it is possible to accurately mount the image forming units in parallel with each other, thereby improving image quality.

DETAILED DESCRIPTION OF PREFERRED EMBODIMENTS

Hereunder, embodiments of the present invention will be explained with reference to the accompanying drawings. In the embodiments, a printer will be explained as an image forming apparatus.

First Embodiment

Figure 2:
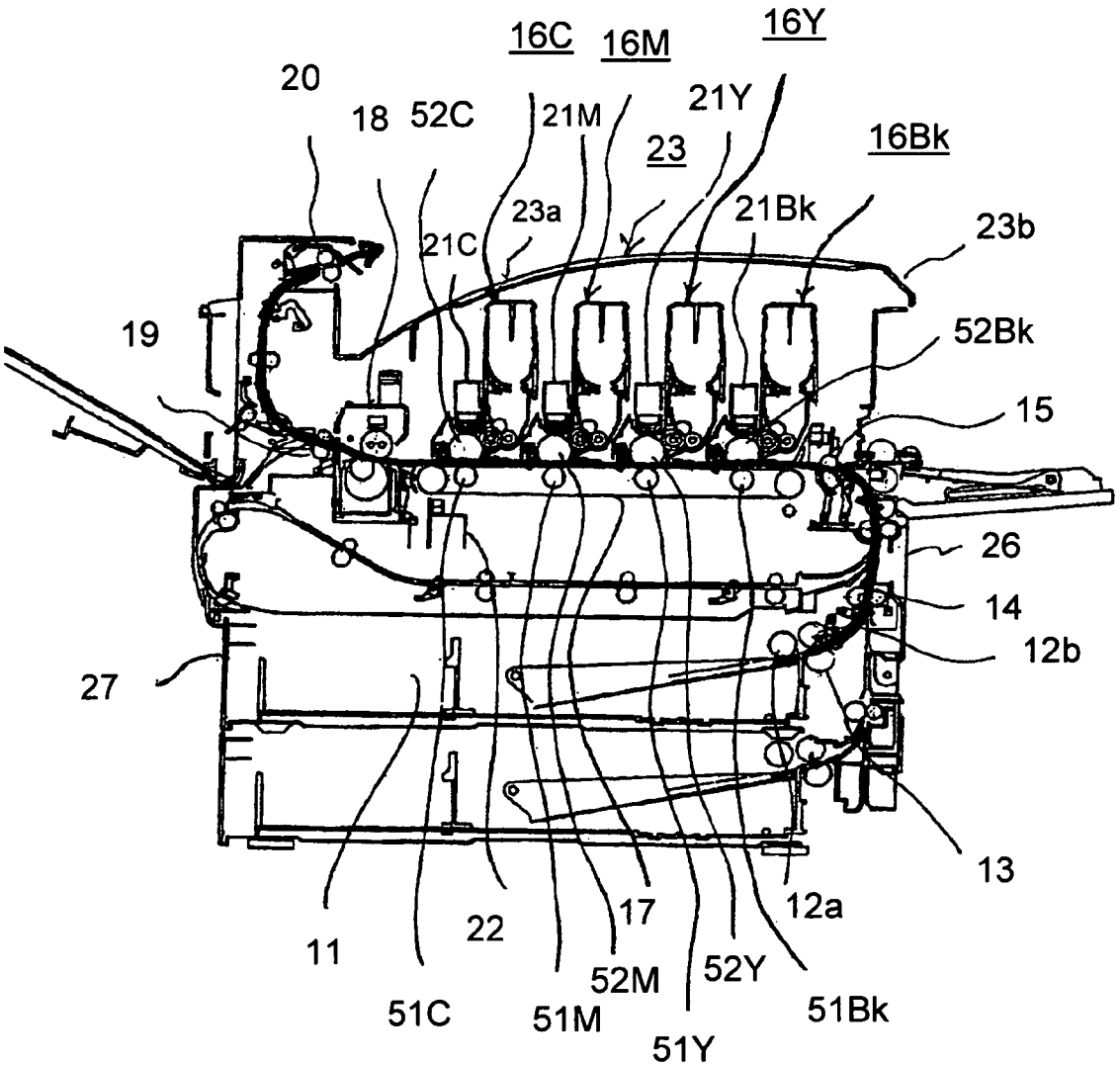
FIG. 2 is a schematic view showing a printer according to the first embodiment of the present invention.
Figure 3:
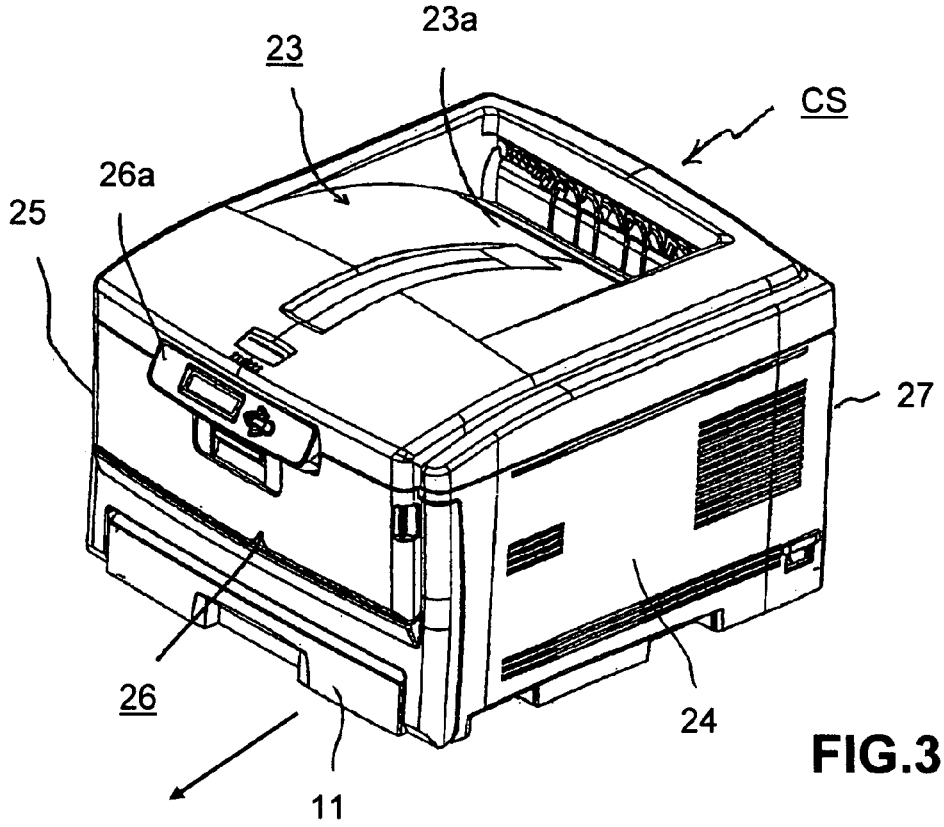
FIG. 3 is a view showing an appearance of the printer according to the first embodiment of the present invention.

FIG. 2 is a schematic view showing a printer according to the first embodiment of the present invention. FIG. 3 is a view showing an appearance of the printer according to the first embodiment of the present invention.

As shown in FIGS. 2 and 3, a housing CS includes a top cover 23 as a top wall; a side cover 24 as a first sidewall on a right side; a side cover 25 as a second sidewall on a left side; a front cover 26 as a front wall; and a rear cover 27 as a rear wall. A sheet discharge cassette 23*a* is formed at an upper surface of the top cover 23. An operation panel 26*a* is formed at an upper end portion of the front cover 26.

A sheet supply cassette 11 is disposed at a lower portion of the printer as a medium storage portion for storing sheets (not shown) as recording media. A sheet supply mechanism is disposed adjacent to the sheet supply cassette 11 for separating and supplying the sheet one by one. In FIG. 2, the sheet supply cassette 11 can be pulled out in an arrow direction, and may be disposed in double.

The sheet supply mechanism includes sheet supply rollers 12*a* and 12*b* and a separation roller 13. After being supplied with the sheet supply mechanism, the sheet is transported to a resist roller 14 disposed at an upper portion, and further to a transport roller 15. Afterward, A transport belt 17 moves to transport the sheet further, so that the sheet passes through between a plurality of image forming units 16Bk, 16Y, 16M, and 16C for forming images in black, yellow, cyan, and magenta, respectively, and transfer rollers 51Bk, 51Y, 51M, and 51C as transfer devices.

Photosensitive drums 52Bk, 52Y, 52M, and 52C as image supporting members form toner images in colors as developer images, and the transfer rollers 51Bk, 51Y, 51M, and 51C in the image forming units 16Bk, 16Y, 16M, and 16C transfer the toner images to the sheet, thereby forming the toner images in colors.

Afterward, the sheet is transported to a fixing device 18, so that the fixing device 18 fixes the toner images to the sheet, thereby forming a color image. After being discharged from the fixing device 18, the sheet is transported with a transport roller 19, and a discharge transport roller 20 discharges the sheet outside the apparatus.

LED heads 21Bk, 21Y, 21M, and 21C are arranged as exposure devices to face the image forming units 16Bk, 16Y, 16M, and 16C, respectively, for exposing surfaces of the photosensitive drums 52Bk, 52Y, 52M, and 52C.

The image forming units 16Bk, 16Y, 16M, and 16C are detachably attached to a main body of the printer. The top cover 23 is disposed at an upper portion of the main body of the printer to freely open and close for attaching and detaching the image forming units 16Bk, 16Y, 16M, and 16C. The top cover 23 constitutes the discharge cassette 23a for placing the sheets thus discharged. The LED heads 21Bk, 21Y, 21M, and 21C are supported on the top cover 23. A sensor unit 22 is disposed under the image forming unit 16C.

Figure 1:
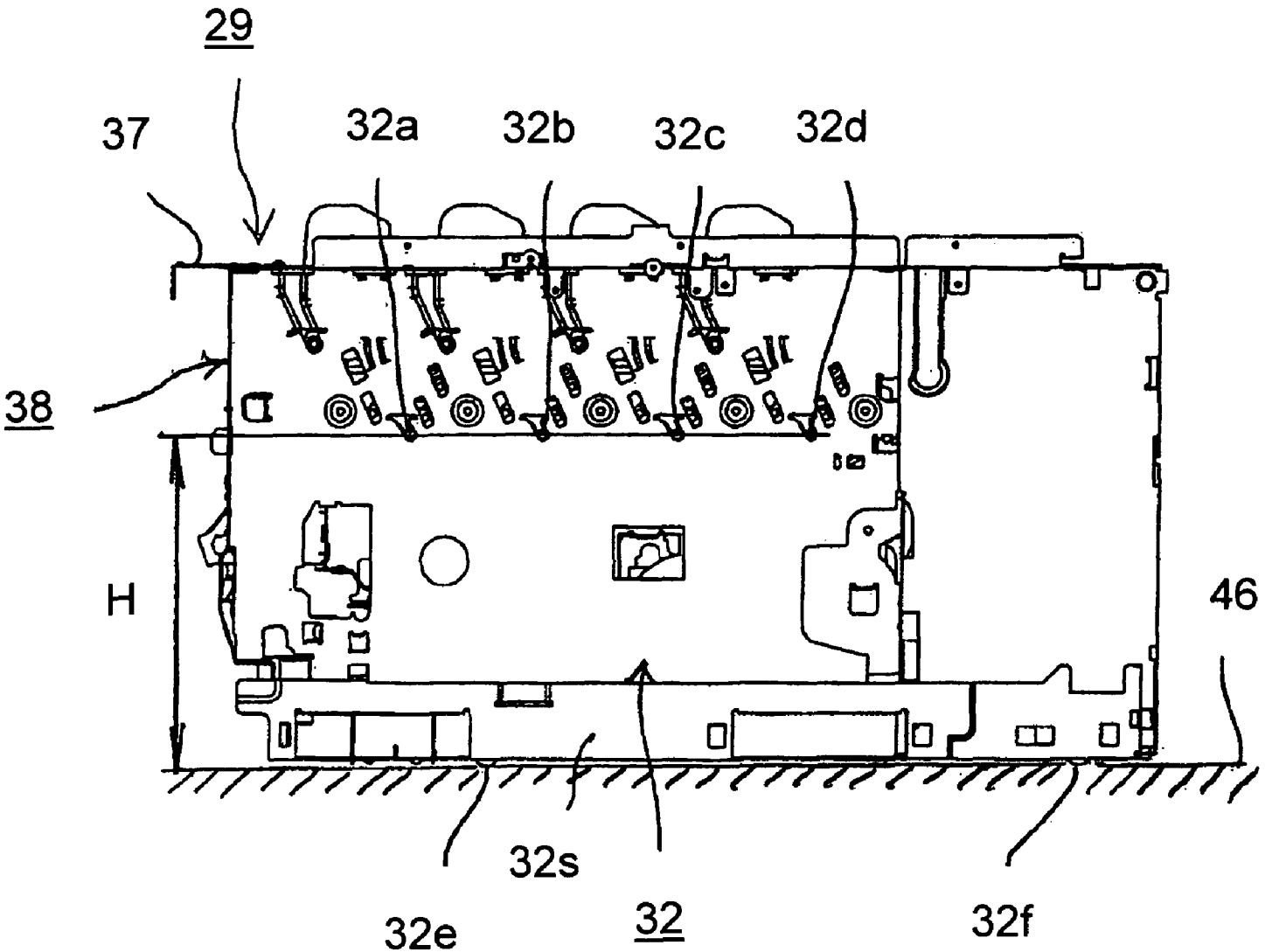
FIG. 1 is a schematic side view showing image forming units in a mounted state according to a first embodiment of the present invention.
Figure 4:
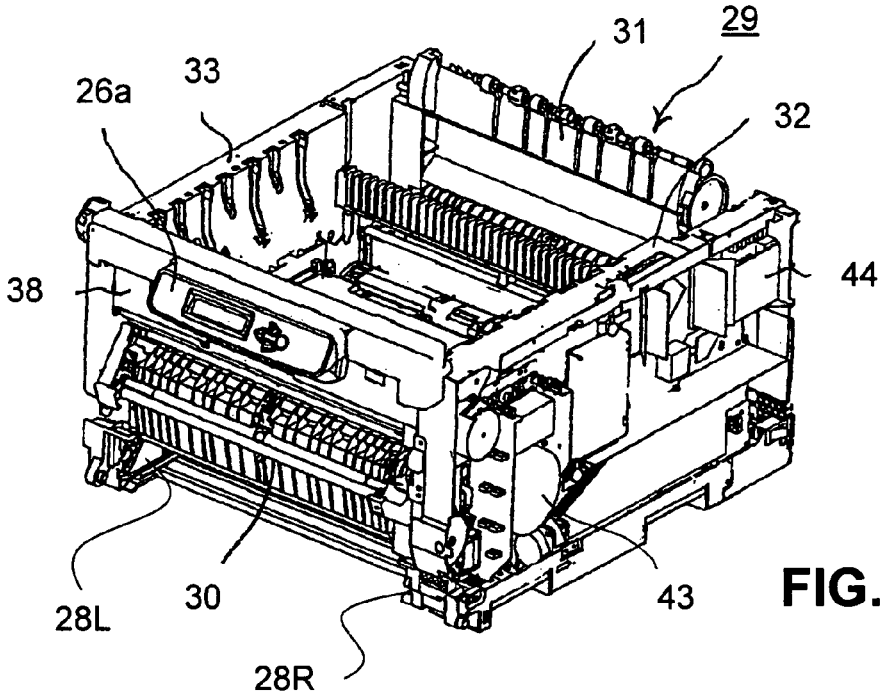
FIG. 4 is a view showing an inside configuration of the printer according to the first embodiment of the present invention.
Figure 5:
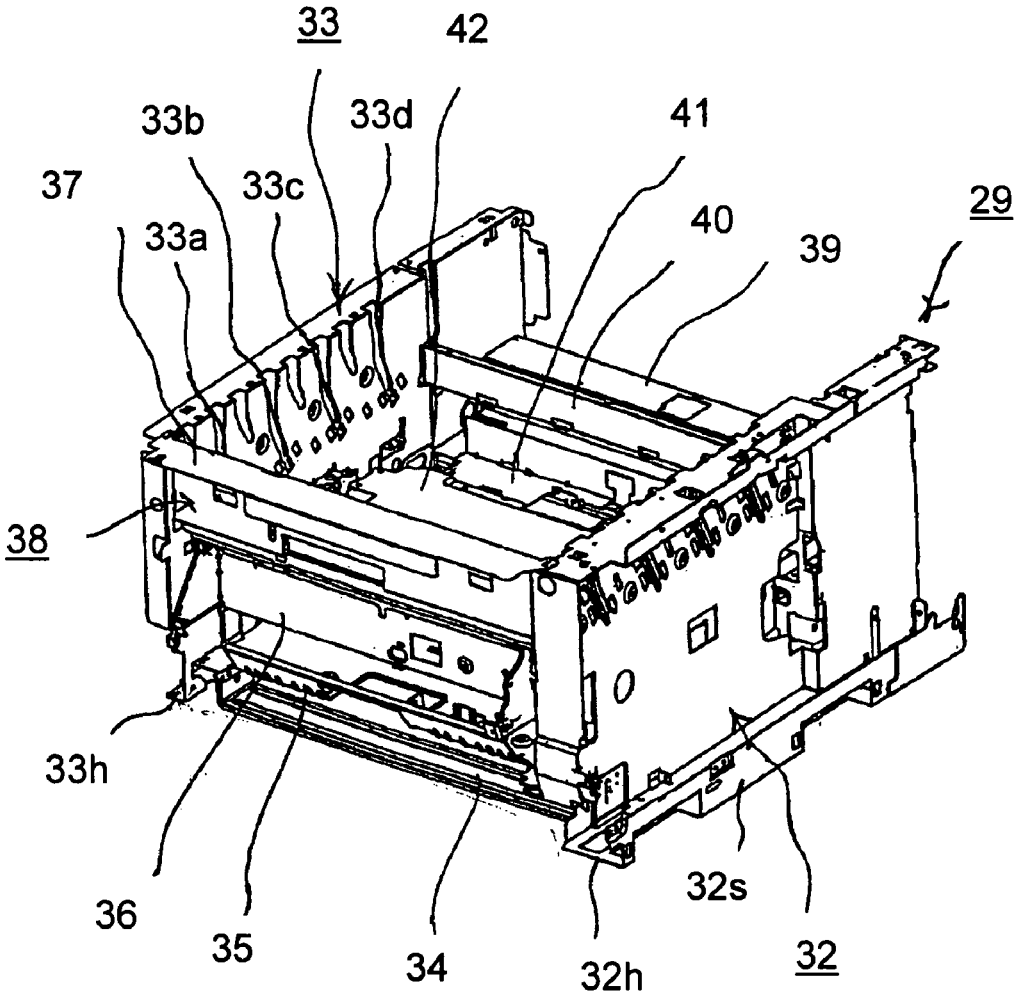
FIG. 5 is a perspective view showing a metal plate structure according to the first embodiment of the present invention.
Figure 6:
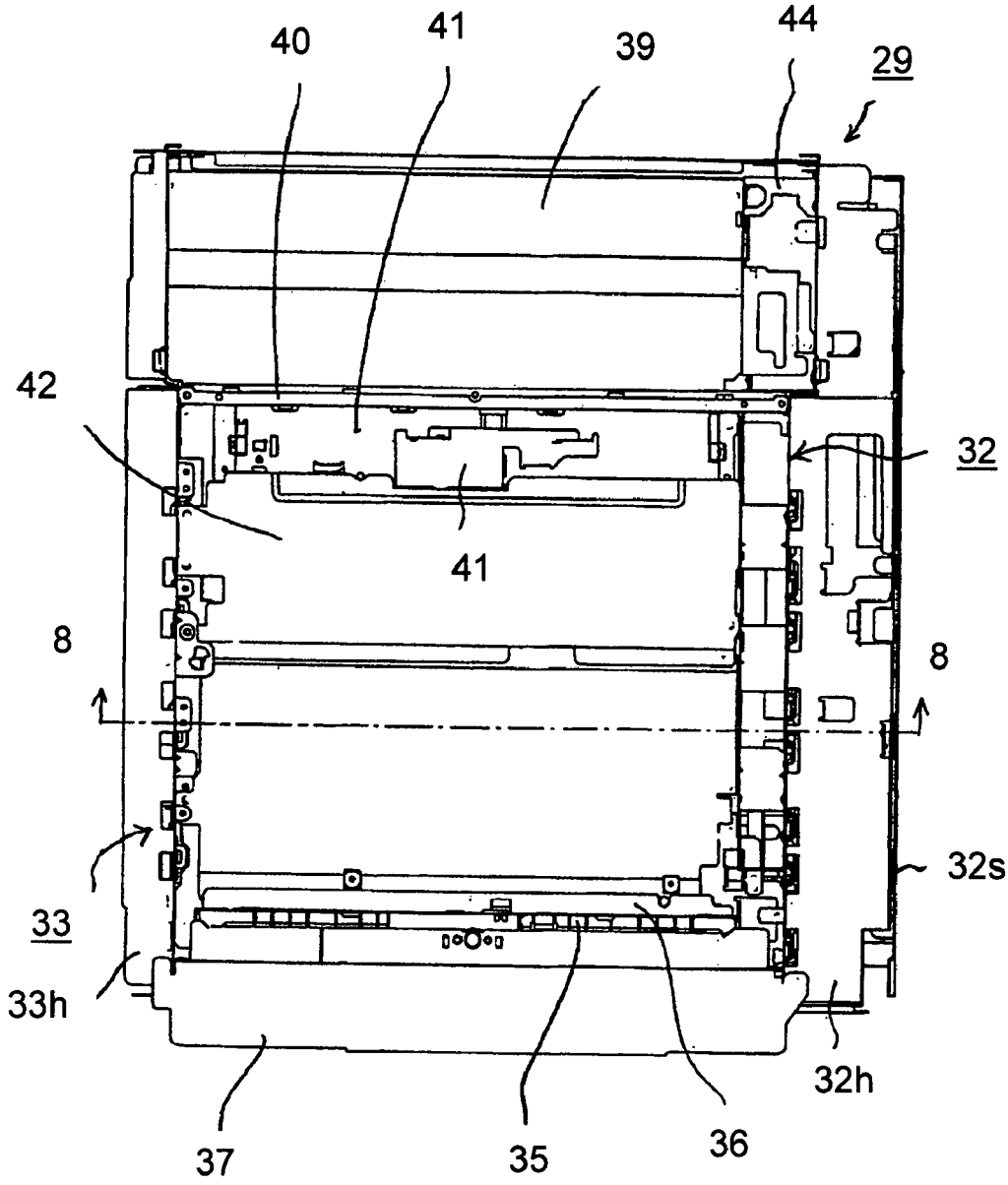
FIG. 6 is a plan view showing the metal plate structure according to the first embodiment of the present invention.
Figure 7:
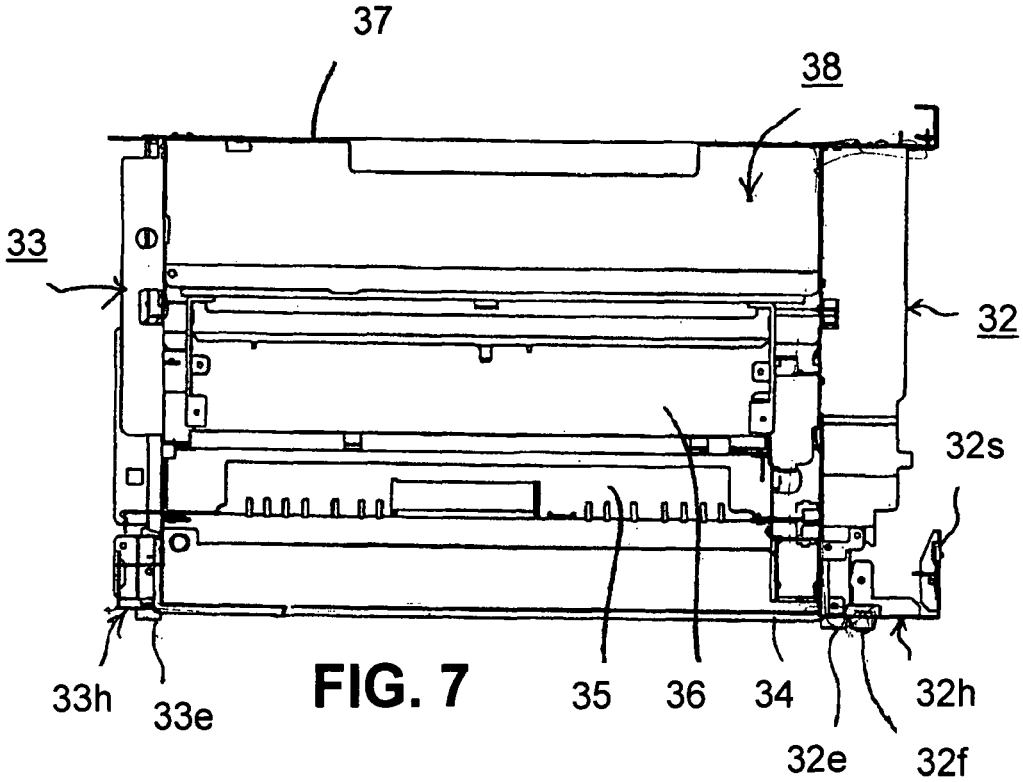
FIG. 7 is a front view showing the metal plate structure according to the first embodiment of the present invention.
Figure 8:
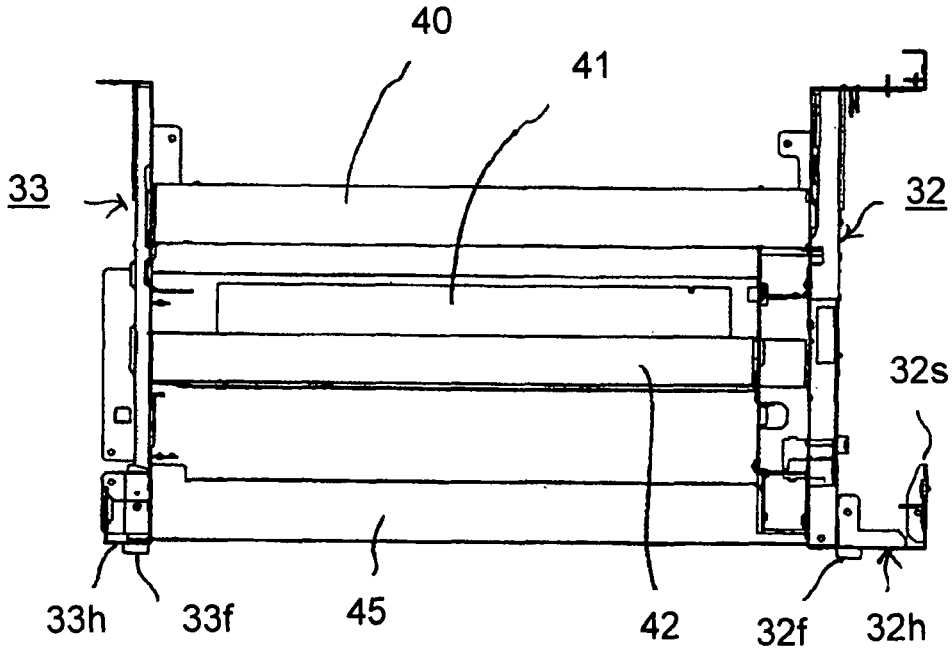
FIG. 8 is a schematic sectional view showing the metal plate structure taken along a line 8-8 in FIG. 6 according to the first embodiment of the present invention.

A mounted state of the image forming units 16Bk, 16Y, 16M, and 16C will be explained next. FIG. 1 is a schematic side view showing image forming units in the mounted state according to a first embodiment of the present invention. FIG. 4 is a view showing an inside configuration of the printer according to the first embodiment of the present invention. FIG. 5 is a perspective view showing a metal plate structure according to the first embodiment of the present invention. FIG. 6 is a plan view showing the metal plate structure according to the first embodiment of the present invention. FIG. 7 is a front view showing the metal plate structure according to the first embodiment of the present invention. FIG. 8 is a schematic sectional view showing the metal plate structure taken along a line 8-8 in FIG. 6 according to the first embodiment of the present invention.

Figure 9:
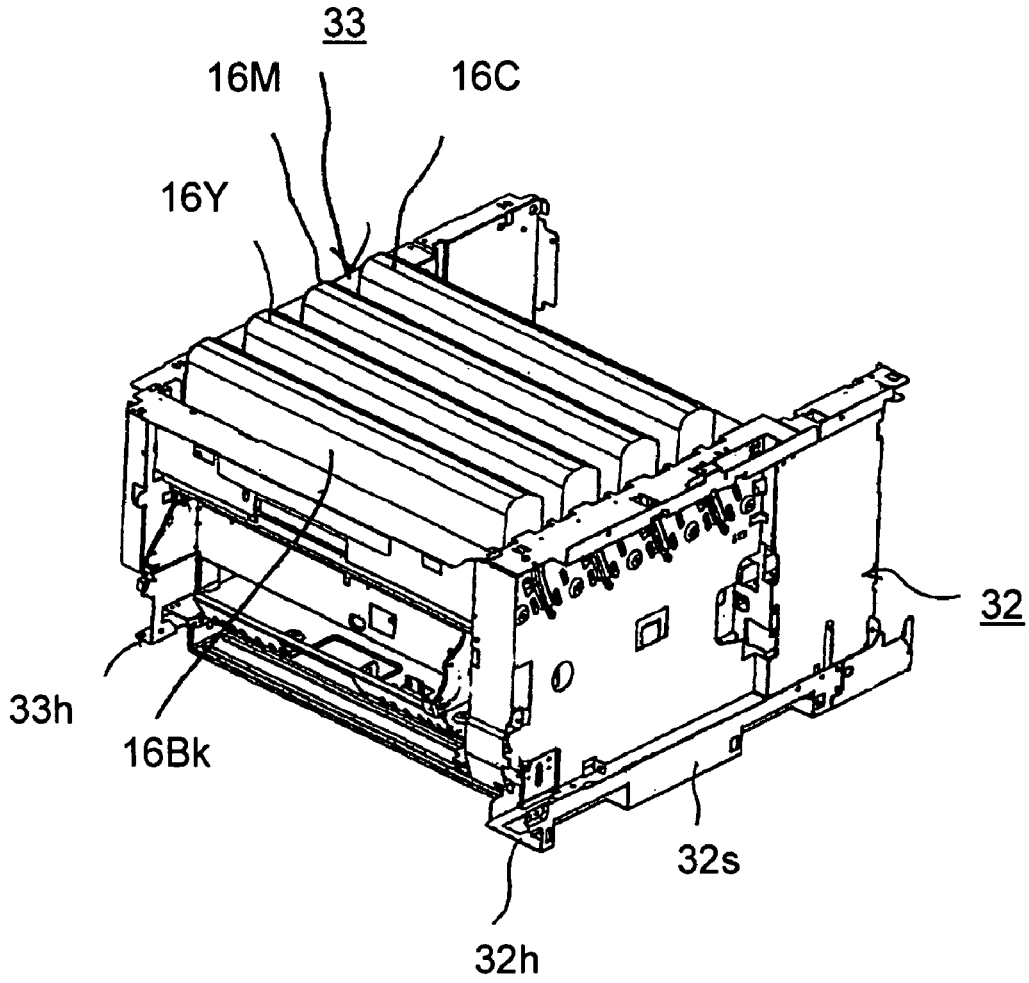
FIG. 9 is a perspective view showing the image forming units in the mounted state according to the first embodiment of the present invention.
Figure 10:
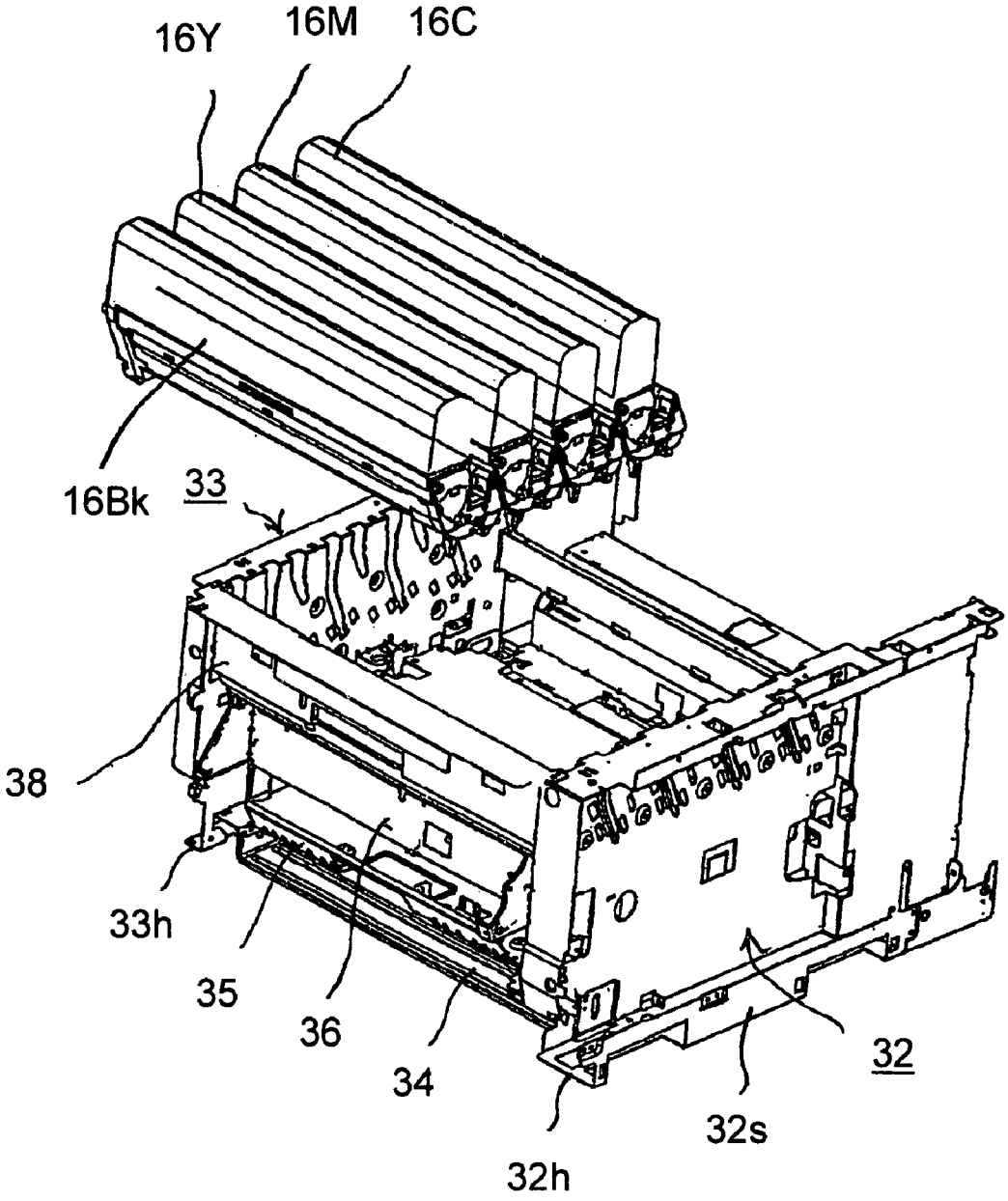
FIG. 10 is a perspective view showing the image forming units in a detached state according to the first embodiment of the present invention.
Figure 11:
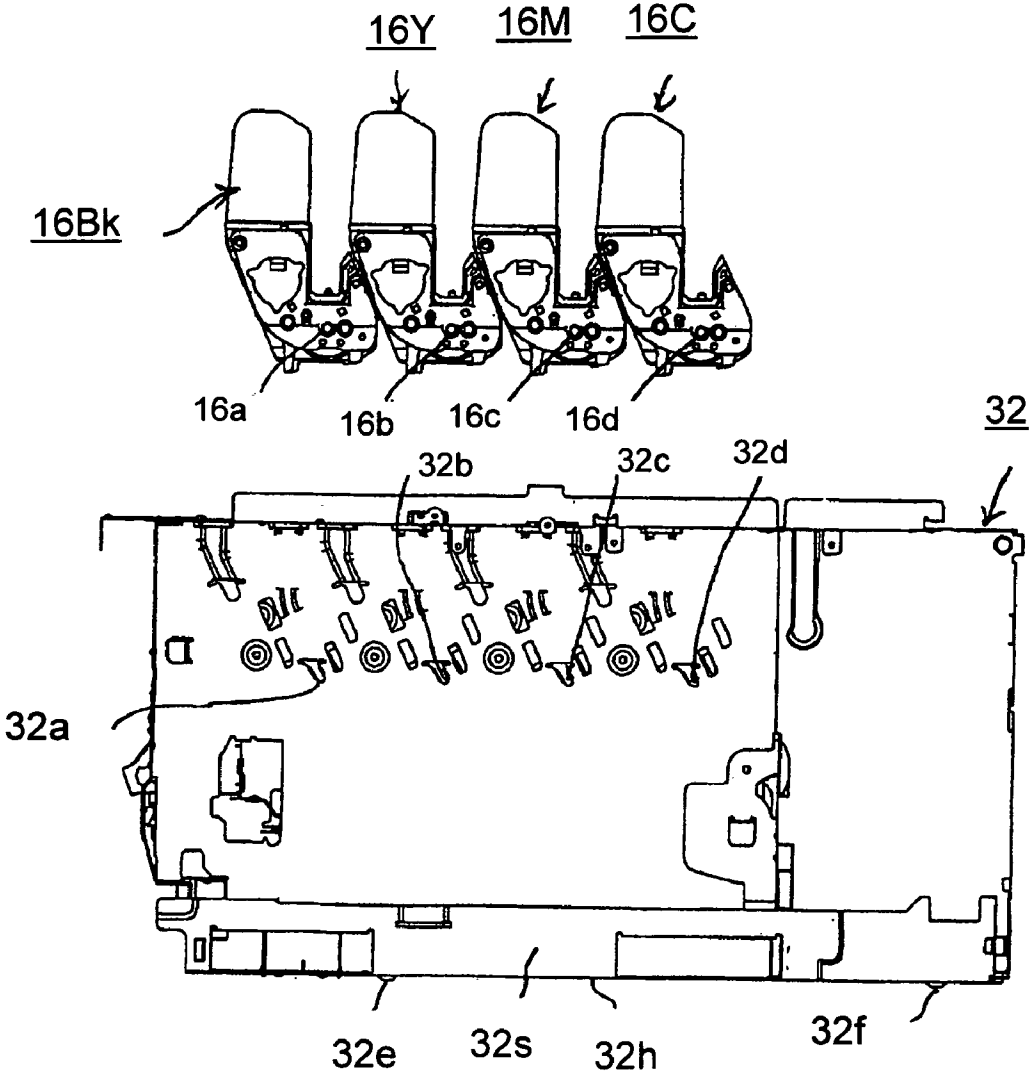
FIG. 11 is a schematic side view showing the image forming units in the detached state according to the first embodiment of the present invention.
Figure 12:
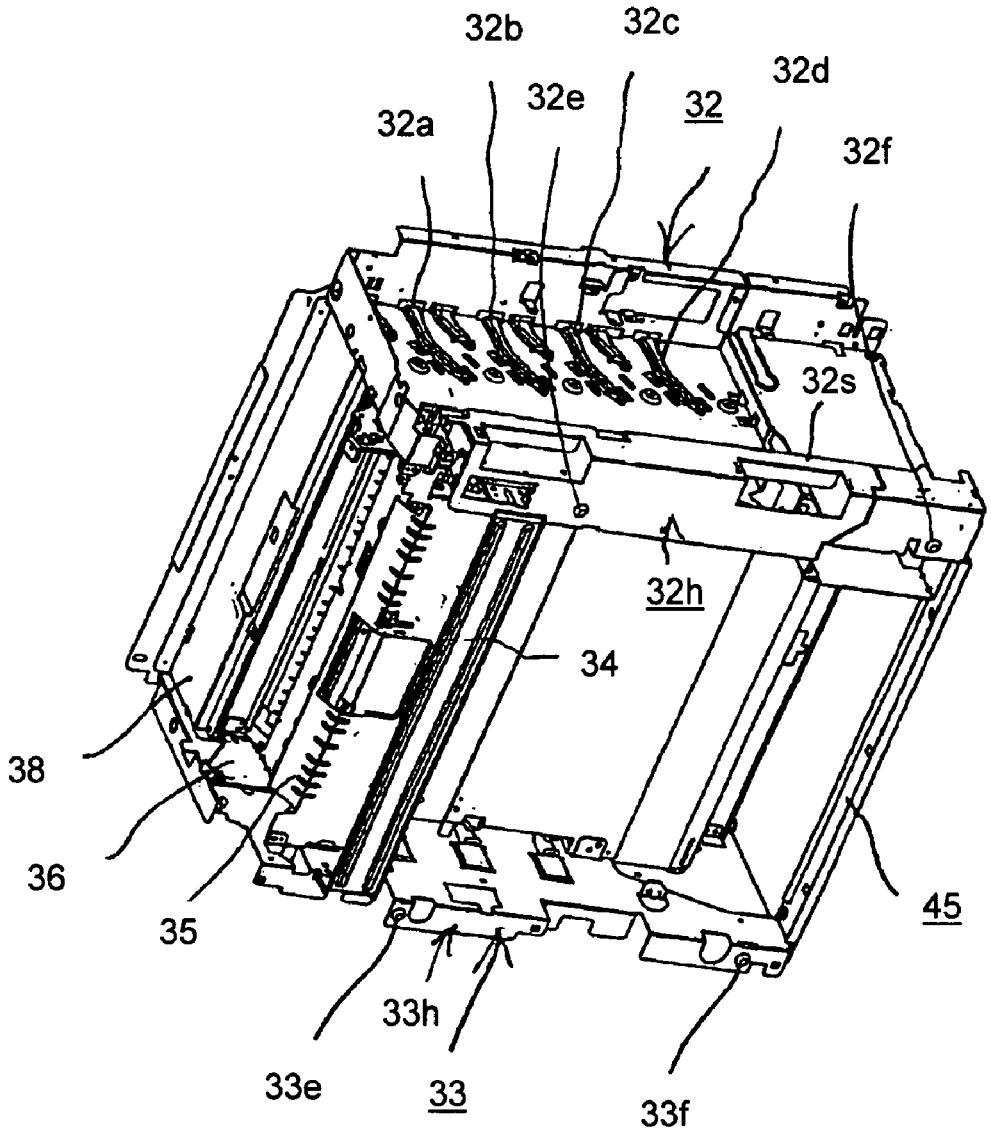
FIG. 12 is a perspective view showing the metal plate structure viewed from a bottom surface thereof according to the first embodiment of the present invention.

Further, FIG. 9 is a perspective view showing the image forming units in the mounted state according to the first embodiment of the present invention. FIG. 10 is a perspective view showing the image forming units in a detached state according to the first embodiment of the present invention. FIG. 11 is a schematic side view showing the image forming units in the detached state according to the first embodiment of the present invention. FIG. 12 is a perspective view showing the metal plate structure viewed from a bottom surface thereof according to the first embodiment of the present invention.

A metal plate structure 29 is formed of a pair of frame bodies as supporting members having a rectangular shape. The metal plate structure 29 is formed of metal plates made of SUS and connected with fixing members such as screws if necessary. The metal plate structure 29 supports both end portions of each of the image forming units 16Bk, 16Y, 16M, and 16C in the housing CS.

The metal plate structure 29 includes a side plate 32 as a first side supporting member extending in a vertical direction inside the side cover 24; a side plate 33 as a second side supporting member extending in a vertical direction inside the side cover 25; a front plate beam 38 as a front supporting member extending in a vertical direction inside the front cover 26 and connecting the side plates 32 and 33; and a rear plate beam 45 as a rear supporting member extending in a vertical direction inside the rear cover 27 and connecting the side plates 32 and 33.

Further, a plate beam 34 as a first connecting member is disposed at a bottom portion of the metal plate structure 29 for connecting front ends of the side plates 32 and 33. A plate base 39 as a second connecting member is disposed at an upper portion of the rear plate beam 45 for connecting rear ends of the side plates 32 and 33.

A resist roller unit 30 including the resist roller and the likes is attached to a lower end portion of the front plate beam 38. A discharge unit 31 including the discharge transport roller 20 and the likes is disposed at an upper portion of the plate base 39.

A plate pickup 35 is provided as a recoding medium picking-up member for connecting front edges of the side plates 32 and 33. A plate holder resist 36 is provided as a supporting element for supporting the resist roller 14. A plate top resist 37 is provided at an upper edge of the front plate beam 38 as an upper edge portion. A plate beam fuser 40 is provided as a supporting element for supporting the fixing device 18. A plate resist sensor 41 is fixed on the plate base 39 as a medium detection unit for detecting the sheet.

A plate cover 42 is disposed inside the metal plate structure 29. A drum motor 43 is provided as a drive unit for driving the photosensitive drums disposed as the image supporting members in the image forming units 16Bk, 16Y, 16M, and 16C, respectively. A fixing motor 44 is provided as a fixing drive unit for driving a roller disposed in the fixing device 18. A mounting surface 44 is provided for mounting the printer. Note that the drum motor 43 and the fixing motor 44 are attached to the side plate 32.

As shown in FIGS. 1, 5, 11, and 12, groove portions 32*a* to 32*d* are formed in the side plate 32 for supporting end portions of the image forming units 16Bk, 16Y, 16M, and 16C, respectively. Similarly, groove portions 33*a* to 33*d* are formed in the side plate 33 for supporting the other end portions of the image forming units 16Bk, 16Y, 16M, and 16C, respectively. The side plates 32 and 33 are press-processed and plastically deformed to form the groove portions 32*a* to 32*d* and 33*a* to 33*d*, respectively. Note that, in FIGS. 1 and 11, only lower edges of the groove portions 32*a* to 33*d* are shown.

As shown in FIG. 4, guide members 28R and 28L are attached to the side plates 32 and 33 through supporting members (not shown) for supporting and guiding the sheet supply cassette 11, respectively. The groove portions 32*a* to 32*d* and 33*a* to 33*d* are integrally formed with the supporting members supporting the guide members 28R and 28L, respectively. Accordingly, it is possible to stably transport the sheet to the image forming units 16Bk, 16Y, 16M, and 16C.

The side plate 32 is provided with, through a press process, a horizontal portion 32*h* extending outward from a lower edge thereof in a horizontal direction, and a standing portion 32*s* extends upward from an edge portion of the horizontal portion 32*h* at a right angle. The side plate 33 is provided with, through a press process, a horizontal portion 33*h* extending outward from a lower edge thereof in a horizontal direction.

Leg portions 32*e* and 32*f* are disposed on a lower surface of the horizontal portion 32*h* for abutting against a mounting surface 46. Also, leg portions 33*e* and 33*f* are disposed on a lower surface of the horizontal portion 33*h* for abutting against the mounting surface 46. The horizontal portions 32*h* and 33*h* are press-processed and plastically deformed to form the leg portions 32*e*, 32*f*, 33*e*, and 33*f* as protrusions.

In the side plate 32, the leg portions 32*e* and 32*f* and the groove portions 32*a* to 32*d* are formed with high accuracy, so that a distance H (FIG. 1) between lower edges of the leg portions 32*e* and 32*f* and lower edges of the groove portions 32*a* to 32*d* is precisely controlled. Similarly, in the side plate 33, the leg portions 33*e* and 33*f* and the groove portions 33*a* to 33*d* are formed with high accuracy, so that the distance H (FIG. 1) between lower edges of the leg portions 33*e* and 33*f* and lower edges of the groove portions 33*a* to 33*d* is precisely controlled.

In the printer with the configuration described above, when the image forming units 16Bk, 16Y, 16M, and 16C are installed, protrusions 16*a* to 16*d* protruding from the end portions of the image forming units 16Bk, 16Y, 16M, and 16C move along the groove portions 32*a* to 32*d* and 33*a* to 33*d*, respectively. When the protrusions 16*a* to 16*d* reach the lower edges of the groove portions 32*a* to 32*d* and 33*a* to 33*d*, the image forming units 16Bk, 16Y, 16M, and 16C are accurately positioned relative to the metal plate structure 29, respectively.

Figure 19:
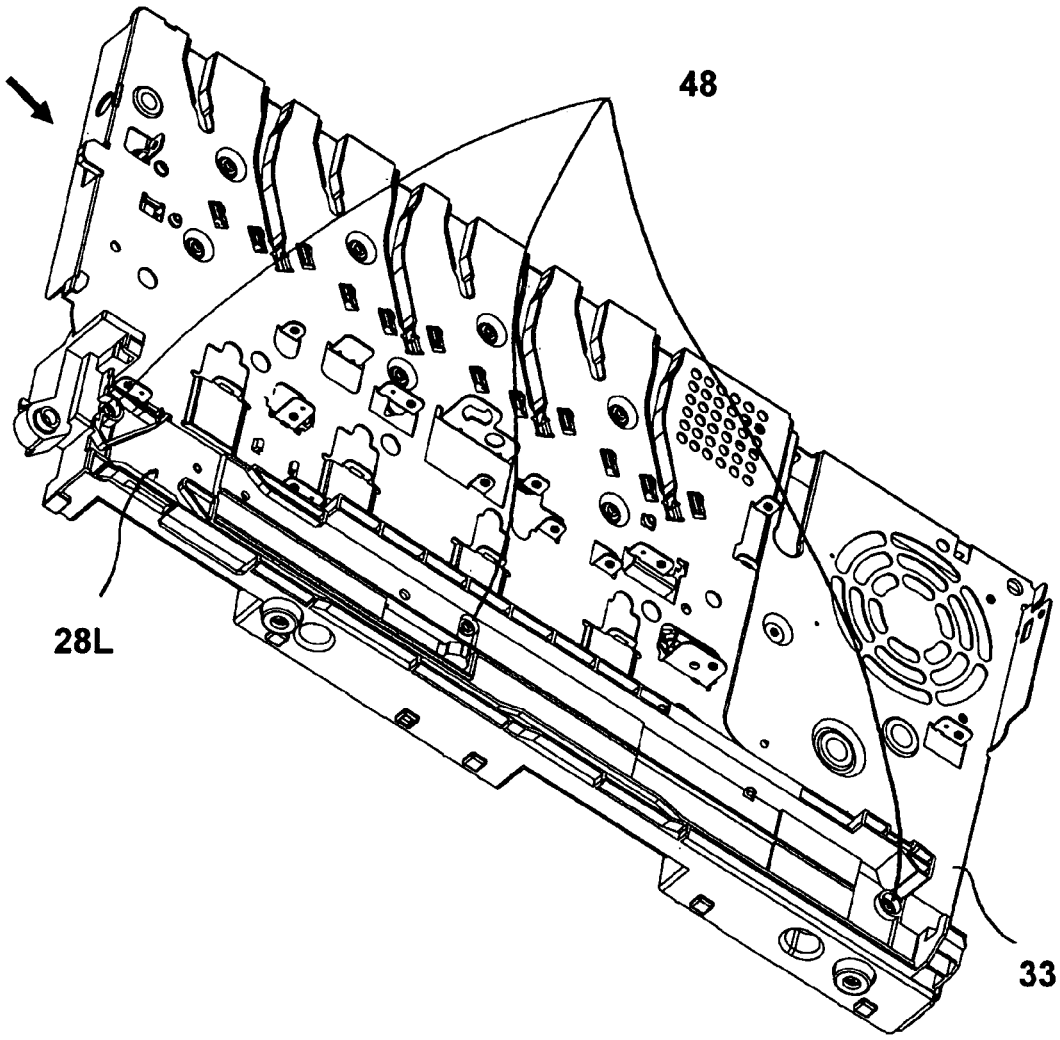
FIG. 19 is a view showing a side plate on a left side of the printer in a state that a guide member is fixed thereto according to the first embodiment of the present invention.
Figure 20:
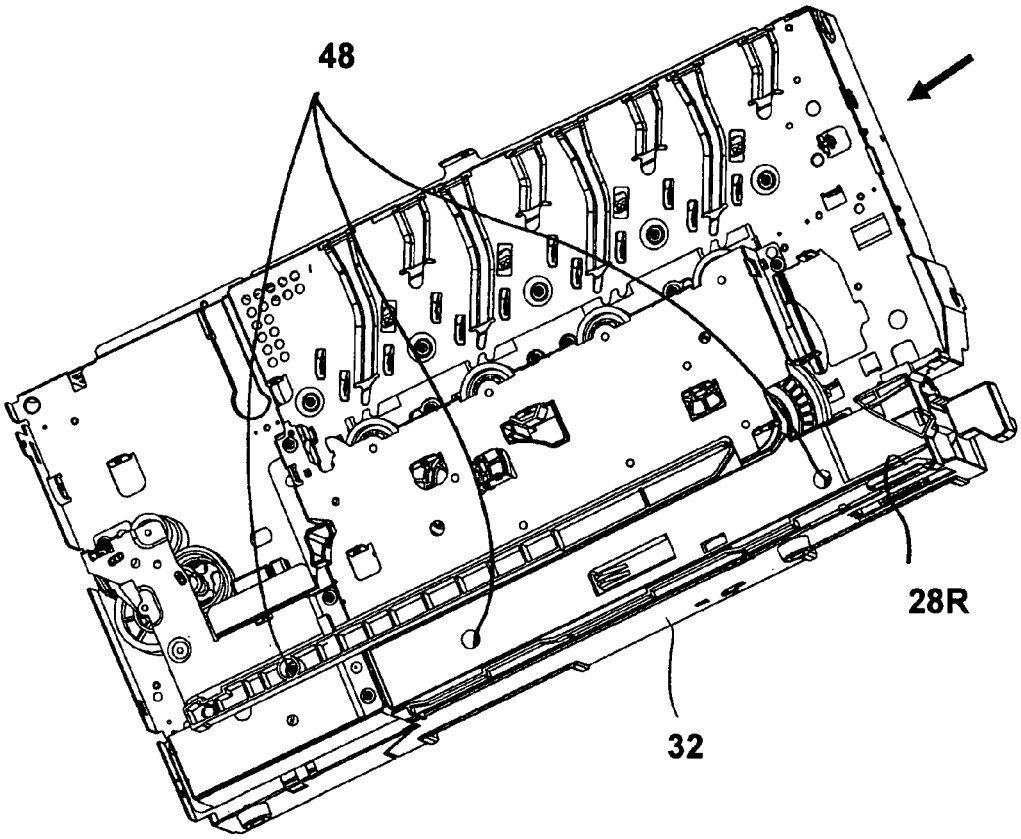
FIG. 20 is a view showing a side plate on a right side of the printer in a state that a guide member is fixed thereto according to the first embodiment of the present invention.

In the embodiment, the guide members 28L and 28R are fixed to the side plates 32 and 33 as follows. FIG. 19 is a view showing the side plate 33 on the left side of the printer in a state that the guide member 28L is fixed thereto according to the first embodiment of the present invention. FIG. 20 is a view showing the side plate 32 on the right side of the printer in a state that the guide member 28R is fixed thereto according to the first embodiment of the present invention.

In FIGS. 19 and 20, arrows present the front side of the printer. After the guide members 28L and 28R are positioned according to screw holes formed in the side plates 32 and 33, the guide members 28L and 28R are fixed to the side plates 32 and 33 with screws 48 as shown in FIGS. 19 and 20. In the embodiment, three screws 48 are fixed into each of the side plates 32 and 33 through the screw holes from inside the printer.

As described above, in the first embodiment, the leg portions 32*e*, 32*f*, 33*e*, and 33*f* are integrated with the side plates 32 and 33 supporting the image forming units 16Bk, 16Y, 16M, and 16C, respectively, and abut against the mounting surface 46. Accordingly, dimensional variances of the components are not accumulated. As a result, it is possible to accurately mount the image forming units 16Bk, 16Y, 16M, and 16C in parallel with each other, respectively. Therefore, it is possible to prevent a color shift upon forming an image or printing, thereby improving image quality.

Second Embodiment

A second embodiment of the present invention will be explained next. Components in the second embodiment having configurations similar to those in the first embodiment are designated with the same reference numerals, and explanations thereof are omitted. The components in the second embodiment similar to those in the first embodiment provide the same effects.

Figure 13:
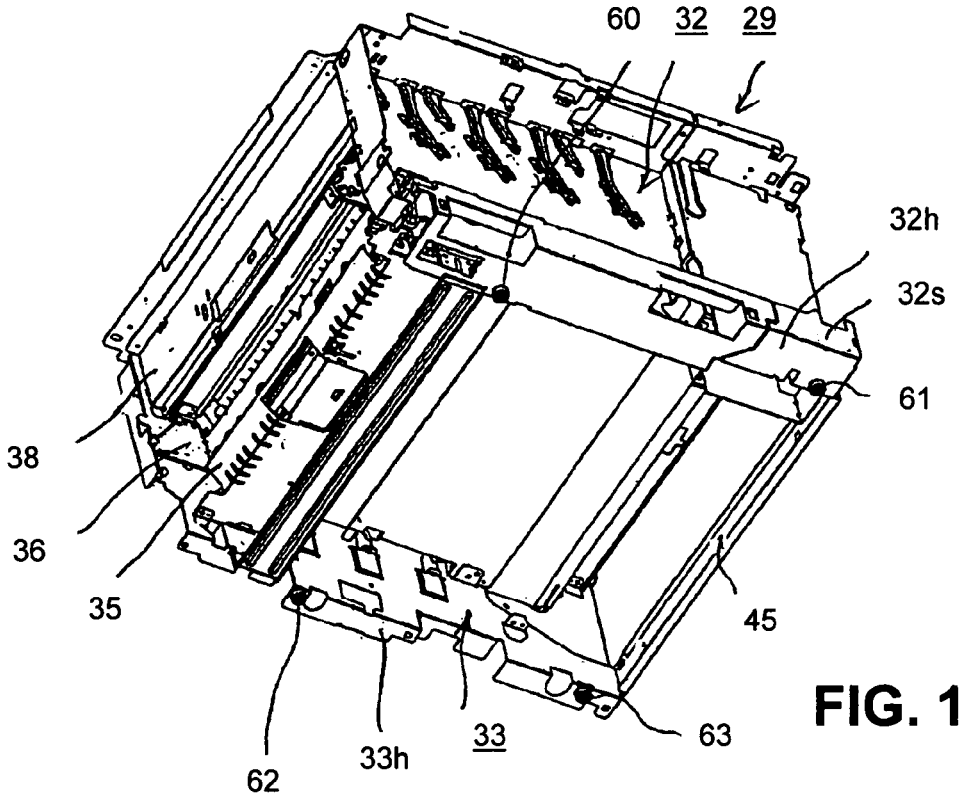
FIG. 13 is a perspective view showing a metal plate structure viewed from a bottom surface thereof according to a second embodiment of the present invention.
Figure 14:
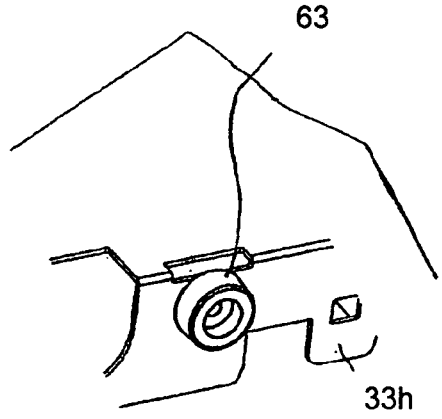
FIG. 14 is an enlarged view showing the bottom surface of the metal plate structure according to the second embodiment of the present invention.

FIG. 13 is a perspective view showing a metal plate structure viewed from a bottom surface thereof according to a second embodiment of the present invention. FIG. 14 is an enlarged view showing the bottom surface of the metal plate structure according to the second embodiment of the present invention.

As shown in FIG. 13, leg portions 60 and 61 are fixed to the horizontal portion 32*h* with bolts and the likes as vibration absorption members, respectively. Similarly, leg portions 62 and 63 are fixed to the horizontal portion 33*h* with bolts and the likes as vibration absorption members, respectively. The leg portions 60 to 63 are formed of a rubber material with a hardness of about 80 such as EVA, respectively. The rubber material functions as a friction member for fixing the printer to the mounting surface 46 not to slide.

In the second embodiment, the leg portions 60 to 63 formed of a rubber material are disposed between the mounting surface 46 and the side plates 32 and 33 supporting the image forming units 16Bk, 16Y, 16M, and 16C, respectively. Accordingly, it is possible to absorb vibrations generated in the printer. Since movements of the image forming units 16Bk, 16Y, 16M, and 16C are restricted, it is possible to accurately mount the image forming units 16Bk, 16Y, 16M, and 16C in parallel with each other.

Third Embodiment

A third embodiment of the present invention will be explained next. Components in the third embodiment having configurations similar to those in the first and second embodiments are designated with the same reference numerals, and explanations thereof are omitted. The components in the third embodiment similar to those in the first and second embodiments provide the same effects.

Figure 15:
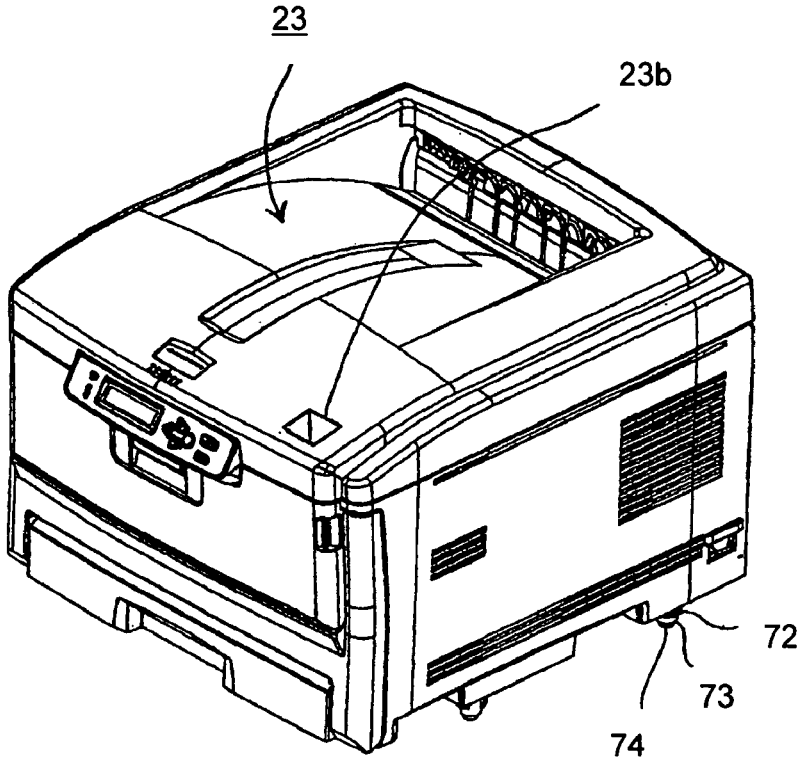
FIG. 15 is a view showing an appearance of a printer according to a third embodiment of the present invention.
Figure 16:
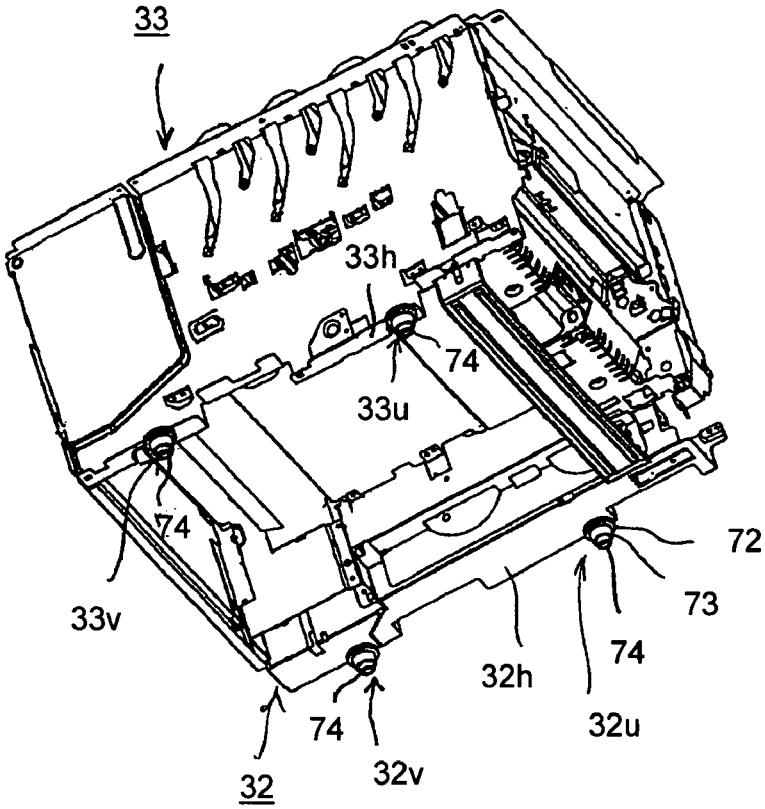
FIG. 16 is a perspective view showing a metal plate structure viewed from a bottom surface thereof according to the third embodiment of the present invention.
Figure 17:
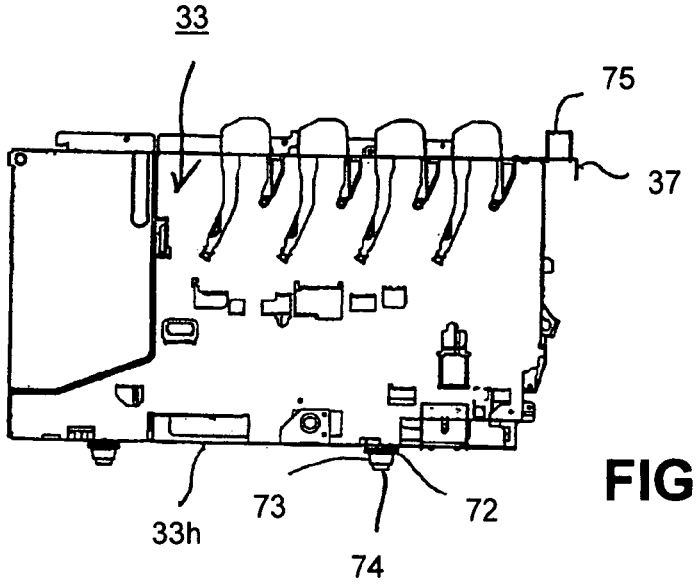
FIG. 17 is a schematic side view showing image forming units in a mounted state according to the third embodiment of the present invention.
Figure 18:
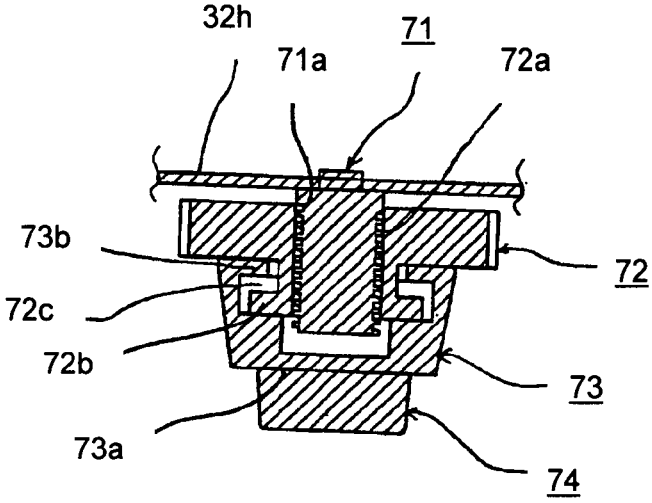
FIG. 18 is a schematic sectional view showing a leg portion according to the third embodiment of the present invention.

FIG. 15 is a view showing an appearance of a printer according to the third embodiment of the present invention. FIG. 16 is a perspective view showing a metal plate structure viewed from a bottom surface thereof according to the third embodiment of the present invention. FIG. 17 is a schematic side view showing image forming units in a mounted state according to the third embodiment of the present invention. FIG. 18 is a schematic sectional view showing a leg portion according to the third embodiment of the present invention.

As shown in FIG. 16, leg portion units 32*u* and 32*v* are disposed on the side plate 32, and leg portion units 33*u* and 33*v* are disposed on the side plate 33, respectively. As shown in FIG. 18, each of the leg portion units 32*u*, 32*v*, 33*u*, and 33*v* is formed of a screw post 71; a spacer 72; a holder 74 for holding the spacer 72; and a leg portion 74 as a vibration absorption member. The leg portion 74 is formed of a rubber material.

The screw post 71 has a screw portion 71*a* as a first screw element on an outer circumference thereof, so that the screw post 71 is fixed to the side plate 32 or 33. The spacer 72 has a screw hole 72*a* a second screw element at a center thereof, so that the screw portion 71*a* is screwed into the screw hole 72*a*. The screw portion 71*a* and the screw hole 72*a* constitute a movement direction changing unit. When the spacer 72 is rotated, the rotational movement of the spacer 72 is changed to a straight movement, so that the screw post 72 moves in an axial direction.

The leg portion 74 is fixed to a bottom portion 73*a* of the holder 73. A flange portion 73*b* is formed at an upper edge of the holder 73, and extends inward in a radial direction. A flange portion 72*b* is formed at a lower edge of the spacer 72, and extends outward in a radial direction. The flange portion 73*b* and the flange portion 72*b* engage with each other to form a gap 72*c*. With the gap 72*c*, it is possible to rotate independently the spacer 72 and the holder 73. Accordingly, in a state that the apparatus is installed, it is possible to easily adjust a height of the metal plate structure 29 by rotating only the spacer 72 without rotating the holder 73 fixed to the leg portion 74.

In the third embodiment, when the spacers 72 are rotated, the screw posts 71 fixed to the horizontal portions 32*h* and 33*h* move in a vertical direction to move the printer itself. A level 75 is disposed on the plate top resist 37 for verifying parallelism of the image forming units 16Bk, 16Y, 16M, and 16C. It is possible to visually confirm the level 75 through an opening portion 23*b* formed in the top cover 23.

As described above, in the third embodiment, it is possible to adjust the leg portion units 32*u*, 32*v*, 33*u*, and 33*v* of the printer main body to move the screw posts 71 in the vertical direction, respectively. Accordingly, even though the leg portions 74 have dimensional variances, it is possible to improve the parallelism of the image forming units 16Bk, 16Y, 16M, and 16C.

In the embodiments described above, the printer is explained. The present invention is applicable to a facsimile, a copier, a combined device, and the likes.

The disclosure of Japanese Patent Application No. 2006-052962, filed on Feb. 28, 2006, is incorporated in the application.

While the invention has been explained with reference to the specific embodiments of the invention, the explanation is illustrative and the invention is limited only by the appended claims.

What is claimed is:

1. An image forming apparatus to be installed on a mounting surface, comprising:

an image forming unit having two end portions in a longitudinal direction thereof;

a supporting member formed of a metal plate member for supporting the image forming unit, said supporting member having a vertical portion and a horizontal portion bent outwardly from the vertical portion, said supporting member further including a first engaging portion for engaging one of the end portions and a second engaging portion for engaging the other of the end portions so that the image forming unit is fixed at a specific position; and a leg portion formed through plastically deforming the horizontal portion of the supporting member in a protruding shape for abutting against the mounting surface so that the leg portion is integrated with the supporting member as one single member, said leg portion being formed through press-processing the horizontal portion, said leg portion having an abutting surface abutting against the mounting surface.

2. The image forming apparatus according to claim 1, wherein said supporting member further includes a first side plate having the first engaging portion, a second side plate having the second engaging portion, a front plate connecting the first side plate and the second side plate at a front side, and a rear plate connecting the first side plate and the second side plate at a rear side.

3. The image forming apparatus according to claim 2, wherein said first side plate includes the horizontal portion with the leg portion formed thereon, said horizontal portion including a bent portion bent upward.

4. The image forming apparatus according to claim 1, further comprising a fixing device supported through the supporting member.

5. The image forming apparatus according to claim 1, wherein said supporting member is formed through press-processing the metal plate member.

* * * * *